US005608508A

United States Patent [19]

Kumagai et al.

[11] Patent Number: 5,608,508

[45] Date of Patent: Mar. 4, 1997

[54] ROTATABLE MEMBER FOR FIXING IN WHICH INORGANIC FILLER IS CONTAINED IN SILICONE RUBBER, AND FIXING DEVICE HAVING THE SAME

[75] Inventors: Hiroaki Kumagai, Kawasaki; Takeshi Menjo, Tokyo; Kazuo Kishino, Kawasaki; Masaaki Takahashi, Asaka; Rie Saito, Yokohama; Jiro Ishizuka, Chiba; Hideo Kawamoto, Kawasaki; Ryuichiro Maeyama, Yokohama, all of Japan

[73] Assignee: Canon Kabushiki Kaisha, Tokyo, Japan

[21] Appl. No.: 407,382

[22] Filed: Mar. 20, 1995

[30] Foreign Application Priority Data

| | | | |
|---|---|---|---|
| Mar. 25, 1994 | [JP] | Japan | 6-055507 |
| Mar. 25, 1994 | [JP] | Japan | 6-055508 |
| Mar. 10, 1995 | [JP] | Japan | 7-051120 |
| Mar. 10, 1995 | [JP] | Japan | 7-051121 |

[51] Int. Cl.[6] ..... G03G 15/20

[52] U.S. Cl. ..... 399/339; 219/216; 428/404; 428/446; 428/450; 428/913

[58] Field of Search ..... 355/282, 285, 355/290, 295, 319; 219/216; 428/469–471, 34.1, 34.7, 35.8, 404, 446, 913, 450; 430/98, 99; 118/60; 432/60

[56] References Cited

U.S. PATENT DOCUMENTS

| | | | |
|---|---|---|---|
| 4,360,566 | 11/1982 | Shimizu et al. | 219/469 X |
| 4,659,621 | 4/1987 | Finn et al. | 430/99 X |
| 4,971,844 | 11/1990 | Schoustra et al. | 428/34.1 |
| 5,049,943 | 9/1991 | Menjo et al. . | |
| 5,243,393 | 9/1993 | Menjo . | |
| 5,285,248 | 2/1994 | Menjo et al. . | |
| 5,319,427 | 6/1994 | Sakurai et al. . | |
| 5,455,313 | 10/1995 | Kurusu et al. | 428/35.8 X |

FOREIGN PATENT DOCUMENTS

| | | |
|---|---|---|
| 5-32898 | 2/1993 | Japan . |
| 5-214250 | 8/1993 | Japan . |

*Primary Examiner*—Shuk Yin Lee

*Attorney, Agent, or Firm*—Fitzpatrick, Cella, Harper & Scinto

[57] ABSTRACT

A fixing rotatable member for use in an image forming apparatus such as a copying apparatus or a laser beam printer is disclosed. The fixing rotatable member includes a base member and an elastic layer provided on the surface thereof. The elastic layer is addition type silicone rubber in which resin-like polyorganosiloxane and 0.1 to 2 percent by weight of inorganic fine powder are mixed.

21 Claims, 3 Drawing Sheets

ROTATABLE MEMBER FOR FIXING IN WHICH INORGANIC FILLER IS CONTAINED IN SILICONE RUBBER, AND FIXING DEVICE HAVING THE SAME

BACKGROUND OF THE INVENTION

1. Field of the Invention

This invention relates to a rotatable member for fixing and a fixing device for application to an image forming apparatus such as a copying apparatus or a laser beam printer 2. Related Background Art A fixing devices in an image forming apparatus of the electrophotographic type such as a copying apparatus or a laser beam printer is such that a recording medium having a toner image transferred thereto is nipped and conveyed by a pair of rollers of the fixing device and is heated and pressed to thereby fix the toner image on the recording medium and make it into a permanent image.

The rollers used in such fixing device are coated with a material such as fluorine resin or silicone rubber which is good in parting property and rich in heat resisting property and wear resistance to thereby form the outer layer thereof.

Particularly where the image forming apparatus of the electrophotographic type is a color copying apparatus which attaches importance to the quality of image, there is the tendency that use is made of fixing rollers having their surfaces coated with silicone rubber.

However, silicone rubber only is low in strength and poses a problem in the use as rollers and therefore, reinforcing silica powder is mixed with it to thereby improve the physical strength thereof.

However, when silicone rubber is reinforced by inorganic powder, 10 to 40 percent by weight, practically 20 to 30 percent by weight of inorganic powder must be mixed with silicone rubber, and when a roller is made of thus reinforced silicone rubber, the problem has come out in which although physical strength is provided, the parting property of toner is extremely reduced and the life of the roller becomes shorter.

In order to suppress such reduction in the parting property of toner, there is an example in which resin-like polyorganosiloxane as a reinforcing agent is mixed with silicone rubber to thereby improve physical strength and the parting property of toner (Japanese Laid-Open Patent Application No. 5-214250).

In recent years, however, with the spread of color copying apparatuses, a tendency toward higher copying speeds has become remarkable and the set temperature for fixing has become higher. Further, with a requirement for a reduction in running cost, a longer life of fixing rollers has become desired. When the set temperature for fixing is thus relatively high, particularly 170° C. or higher and the roller is used for a long time, the problem has become conspicuous that the fixing and pressing roller using as its surface layer the added type silicone rubber having the aforementioned reinforcing resin-like polyorganosiloxane mixed therewith becomes reduced in its strength by thermal deterioration and the life of the roller becomes remarkably shorter.

Particularly, when a color both-side copying machine is considered, toner comes into contact also with the pressing roller and a high parting property is required also of the pressing roller and therefore, it is preferable that the added type silicone rubber having the aforementioned reinforcing resin-like polyorganosiloxane mixed therewith be used as the surface layer, but a member for removing any excess of silicone oil imparted to the fixing roller or for removing any toner and paper powder offset to the roller bears against the pressing roller, and when the strength of the roller is reduced by thermal deterioration, there has been the problem that when they frictionally contact with the pressing roller, they impart injuries to the pressing roller, which thus becomes shorter in life than the fixing roller.

SUMMARY OF THE INVENTION

It is an object of the present invention to provide a rotatable member for fixing and a fixing device which are excellent in the parting property of toner and physical strength.

It is another object of the present invention to provide a fixing rotatable member having as its surface layer addition type silicone rubber in which resin-like polyorganosiloxane and 0.1 to 2 percent by weight of inorganic fine powder are mixed with each other.

It is still another object of the present invention to provide a pressing rotatable member having as its surface layer addition type silicone rubber in which resin-like polyorganosiloxane and 0.5 to 8 percent by weight of inorganic fine powder are mixed with each other.

It is yet still another object of the present invention to provide a fixing device having a fixing rotatable member having as its surface layer addition type silicone rubber in which resin-like polyorganosiloxane and 0.1 to 2 percent by weight of inorganic fine powder are mixed with each other, and a pressing rotatable member having as its surface layer addition type silicone rubber in which resin-like polyorganosiloxane and 0.5 to 8 percent by weight of inorganic fine powder are mixed with each other.

It is another object of the present invention to provide a fixing device in which the amount of inorganic fine powder of a pressing rotatable member is greater than the amount of inorganic fine powder of a fixing rotatable member.

Further object of the present invention will become apparent from the following detailed description.

DESCRIPTION OF THE PREFERRED EMBODIMENTS

Some embodiments of the present invention will hereinafter be described with reference to the drawings.

Figure 1:
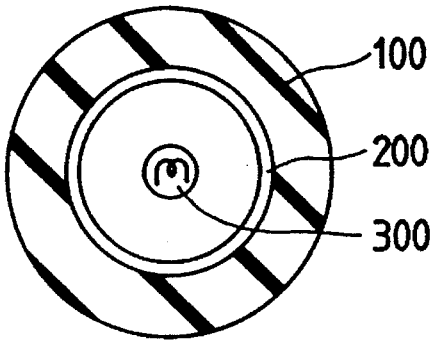
FIG. 1 is a cross-sectional view of a single-layer fixing roller to which the present invention is applied.
Figure 2:
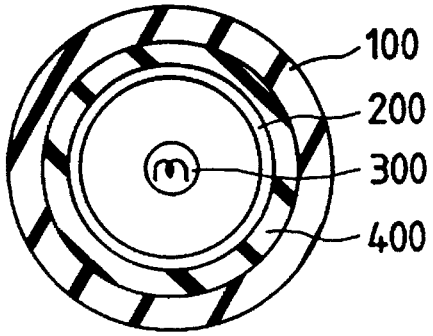
FIG. 2 is a cross-sectional view of a two-layer fixing roller to which the present invention is applied.
Figure 3:
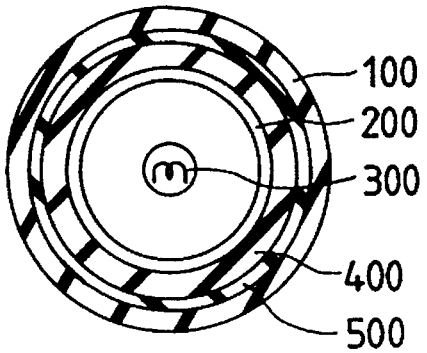
FIG. 3 is a cross-sectional view of a three-layer fixing roller to which the present invention is applied.

FIGS. 1 to 3 are schematic cross-sectional views of rotatable members for fixing (a fixing roller and a pressing roller) having as their outer layers addition type silicone roller which is the elastic layer of the present invention.

Referring to FIG. 1 which is a schematic cross-sectional view of the rotatable member for fixing when it is a single-layer roller, the reference numeral 100 designates the addition type silicone rubber which contacts with toner, the reference numeral 200 denotes a mandrel using aluminum or the like as a base material, and the reference numeral 300 designates a heater for heating.

Referring to FIG. 2 which is a schematic cross-sectional view of the rotatable member for fixing when it is a two-layer roller, the reference numerals 100 to 300 designate the same members as those in FIG. 1, and the reference numeral 400 denotes the silicone rubber of a lower layer.

Referring to FIG. 3 which is a schematic cross-sectional view of the rotatable member for fixing when it is a three-layer roller, the reference numerals 100–400 denote the same members as those in FIG. 2, and the reference numeral 500 designates an oil barrier layer formed of fluorine metamorphic silicone rubber provided between the addition type silicone rubber which contacts with toner and the silicone rubber 400 of the lower layer.

Description will now be made of some embodiments of the addition type silicone rubber which is the surface layer shown in FIGS. 1 to 3. For the comparison of the heat resisting property of the silicone rubber, the degree of thermal deterioration of the silicone rubber has been measured from the rate of variation in dynamic viscoelasticity (tanδ) and the values thereof are also described below.

(Embodiment 1)

Addition type silicone rubber (composition) in which 0.1 percent by weight of silica powder (R-972 produced by Nippon Aerosil Co., Ltd.) as a heat resistance imparting agent which is inorganic minute powder was mixed with a polysiloxane mixture comprising 40 percent by weight of normal chain-like polydimethylsiloxane having its distal end enclosed by vinyl radical of which the viscosity at 25° C. is 10000 Pa·s, and 60 percent by weight of reinforcing resin-like organopolydimethylsiloxane composed of a block polymer of which the viscosity at 25° C. is 35 Pa·s and which has trifunctional and tetrafunctional resin segments and a bifunctional oil segment in one and the same molecule was hardened at 150° C. in 10 minutes, whereafter it was subjected to secondary vulcanization at 200° C. for 4 hours to thereby obtain addition type silicone rubber. This addition type silicone rubber was made into a silicone rubber sheet of 150 mm×150 mm×1 mm, and this sheet was left in an oven of 200° C. and thermal shock was applied thereto for a predetermined time, whereafter a test piece of 40 mm×5 mm×1 mm was punched, and the measurement of tanδ was effected by a rheospectrometer produced by Rheolozy, Inc.

When the degree of thermal deterioration of the silicone rubber was evaluated from the rate of variation with respect to the initial value of this tanδ, the rate of Variation in tanδ at 200° C. was −31% after 120 hours and −36% after 240 hours.

(Embodiment 2)

When the degree of thermal deterioration of the addition type silicone rubber was examined by the use of the same technique as Embodiment 1 with the exception that the amount of mix of silica powder (R-972 produced by Nippon Aerosil Co., Ltd.) was 0.5 percent by weight, the rate of variation in tanδ was −20% after 120 hours and −27% after 240 hours.

(Embodiment 3)

When the degree of thermal deterioration of the addition type silicone rubber was examined by the use of the same technique as Embodiment 1 with the exception that the amount of mix of silica powder (R-972 produced by Nippon Aerosil Co., Ltd.) was 1 percent by weight, the rate of variation in tanδ was 0% after 120 hours and −7% after 240 hours.

(Embodiment 4)

When the degree of thermal deterioration of the addition type silicone rubber was examined by the use of the same technique as Embodiment 1 with the exception that the amount of mix of silica powder (R-972 produced by Nippon Aerosil Co., Ltd.) was 2 percent by weight, the rate of variation in tanδ was +7% after 120 hours and +2% after 240 hours.

(Embodiment 5)

When the degree of thermal deterioration of the addition type silicone rubber was examined by the use of the same technique as Embodiment 1 with the exception that the amount of mix of silica powder (R-972 produced by Nippon Aerosil Co., Ltd.) was 3% by weight, the rate of variation in tanδ was +21% after 120 hours and +18% after 240 hours.

(Embodiment 6)

When the degree of thermal deterioration of the addition type silicone rubber was examined by the use of the same technique as Embodiment 1 with the exception that the amount of mix of silica powder (R-972 produced by Nippon Aerosil Co., Ltd.) was 5 percent by weight, the rate of variation in tanδ was +39% after 120 hours and +46% after 240 hours.

(Embodiment 7)

When the degree of thermal deterioration of the addition type silicone rubber was examined by the use of the same technique as Embodiment 1 with the exception that the amount of mix of silica powder (R-972 produced by Nippon Aerosil Co., Ltd.) was 8 percent by weight, the rate of variation in tanδ was +45 after 120 hours and +50% after 240 hours.

(Embodiment 8)

When the degree of thermal deterioration of the addition type silicone rubber was examined by the use of the same technique as Embodiment 1 with the exception that the amount of mix of alumina (Aluminum Oxide C produced by Nippon Aerosil Co., Ltd.) as a heat resistance imparting agent was 1 percent by weight, the rate of variation in tanδ was −5% after 120 hours and −9% after 240 hours.

(Embodiment 9)

When the degree of thermal deterioration of the addition type silicone rubber was examined by the use of the same technique as Embodiment 1 with the exception that 1 percent by weight of silica powder (R-972 produced by Nippon Aerosil Co., Ltd.) as a heat resistance imparting agent was mixed with a mixture of 10 percent by weight of normal chain-like polydimethylsiloxane having its distal end enclosed by vinyl radical of which the viscosity at 25° C. is 10000 Pa·s and 90 percent by weight of reinforcing resin-like organopolysiloxane composed of a block polymer of which the viscosity at 25° C. is 35 Pa·s and which has trifunctional and tetrafunctional resin segments and a bifunctional oil segment in one and the same molecule, the rate of variation in tanδ was +10% after 120 hours and +11% after 240 hours.

(Embodiment 10)

When the degree of thermal deterioration of the addition type silicone rubber was examined by the use of a technique similar to Embodiment 1 with the exception that the ratio of mix of the normal chain-like polydimethylsiloxane and reinforcing resin-like organopolysiloxane used in Embodiment 9 was 20:80 and use was made of addition type silicone rubber having mixed therewith 1 percent by weight of silica powder (R-972 produced by Nippon Aerosil Co., Ltd.) as a heat resistance imparting agent, the rate of variation in tanδ was +6% after 120 hours and +2% after 240 hours.

(Embodiment 11)

When the degree of thermal deterioration of the addition type silicone rubber was examined by the use of a technique similar to Embodiment 1 with the exception that the ratio of mix of the normal chain-like polydimethylsiloxane and reinforcing resin-like organopolysiloxane used in Embodiment 9 was 50:50 and use was made of addition type silicone rubber having mixed therewith silica powder (R-972 produced by Nippon Aerosil Co., Ltd.) as a heat resistance imparting agent, the rate of Variation in tanδ was −7% after 120 hours and −11% after 240 hours.

Description will now be made of comparative examples for making comparison with the present invention.

(Comparative Example 1)

When the degree of thermal deterioration of the addition type silicone rubber was examined by the use of a technique similar to Embodiment 1 with the exception that the ratio of mixture of normal chain-like polydimethylorganosiloxane and reinforcing resin-like organopolysiloxane in the addition type silicone rubber was 40:60 and a heat resistance imparting agent was not mixed, the rate of variation in tanδ was −44% after 120 hours and −48% after 240 hours.

(Comparative Example 2)

When the degree of thermal deterioration of the addition type silicone rubber was examined by the use of a technique similar to Embodiment 1 with the exception that 10 percent by weight of silica powder (R-972 produced by Nippon Aerosil Co., Ltd.) as a heat resistance imparting agent was mixed with addition type silicone rubber of the same proportion as Comparative Example 1, the rate of variation in tanδ was +47% after 120 hours and +54% after 240 hours.

(Comparative Example 3)

When the degree of thermal deterioration of the addition type silicone rubber was examined by the use of a technique similar to Embodiment 1 with the exception that use was made of addition type silicone rubber having 10 percent by weight of silica powder (R-972 produced by Nippon Aerosil Co., Ltd.) as a reinforcing agent mixed with normal chain-like polydimethylsiloxane having its distal end enclosed by vinyl radical of which the viscosity at 25° C. is 8000 Pa·s, the rate of variation in tanδ was +4% after 120 hours and +11% after 240 hours.

(Comparative Example 4)

When the degree of thermal deterioration of the addition type silicone rubber was examined by the use of a technique similar to Embodiment 1 with the exception that the ratio of mix of the normal chain-like polydimethylsiloxane and reinforcing resin-like organopolysiloxane used in Embodiment 9 was 60:40 and use was made of addition type silicone rubber having mixed therewith 1 percent by weight of silica powder (R-972 produced by Nippon Aerosil Co., Ltd.) as a heat resistance imparting agent, the rate of variation in tanδ was −39% after 120 hours and −43% after 240 hours.

The above results are shown in Tables 1 and 2 below.

In Table 1, conditions are the same except the amount of silica.

In Table 2, conditions are changed besides the amount of silica, and this table is given for reference.

TABLE 1

| | rate of variation in tanδ after heat history of 200° C. | |
|---|---|---|
| | after 120 hours | after 240 hours |
| Embodiment 1 (silica 0.1%) | −31 | −36 |
| Embodiment 2 (silica 0.5%) | −20 | −27 |
| Embodiment 3 (silica 1%) | 0 | −7 |
| Embodiment 4 (silica 2%) | 7 | 2 |
| Embodiment 5 (silica 34%) | 21 | 18 |
| Embodiment 6 (silica 5%) | 39 | 46 |
| Embodiment 7 (silica 8%) | 45 | 50 |
| Comp. Ex. 1 (silica 0%) | −44 | −48 |
| Comp. Ex. 2 (silica 10%) | 47 | 55 |

TABLE 2

| | rate of variation in tanδ after heat history of 200° C. | |
|---|---|---|
| | after 120 hours | after 240 hours |
| Embodiment 8 | −5 | −9 |
| Embodiment 9 | 10 | 11 |
| Embodiment 10 | 6 | 2 |
| Embodiment 11 | −7 | −11 |
| Comp. Ex. 3 | 4 | 11 |
| Comp. Ex. 4 | −39 | −43 |

As shown in Table 1, it is seen that the heat resisting property is improved by mixing silica.

The addition type silicone rubber in the embodiments can be addition type silicone rubber provided by hardening a polysiloxane mixture having a heat resistant inorganic filler mixed with a polysiloxane mixture having 10 to 50 percent by weight of normal chain-like polydimethylsiloxane having its distal end enclosed by vinyl radical of which the viscosity at 25° C. is 8000 Pa·s or greater and 50 to 90 percent by weight of reinforcing resin-like polyorganosiloxane having two or more vinyl radicals and containing a resin segment of which the composition unit includes at least one of tetrafunctionality and trifunctionality and a bifunctional segment and of which the viscosity at 25° C. is 1 Pa·s or greater.

Next, an experiment is effected with fixing and pressing rollers which were made on an experimental basis by the use of the silicone rubber in the present invention actually used in the fixing device of a full color both-side image forming apparatus.

The full color both-side image forming apparatus and its fixing device will first be described here.

Figure 4:
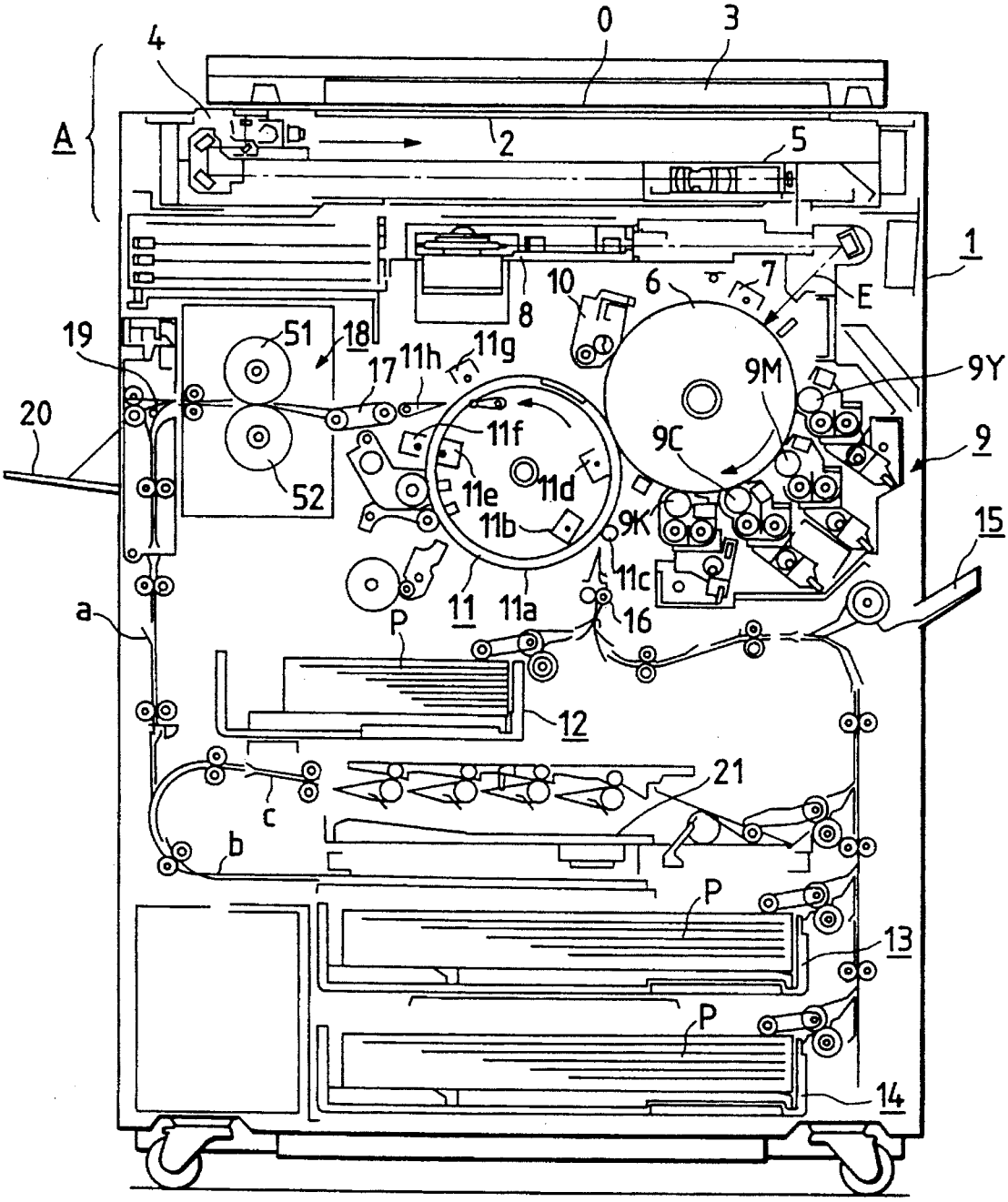
FIG. 4 is a cross-sectional view of a both-side image forming apparatus to which the present invention is applied.

FIG. 4 schematically shows the construction of an image forming apparatus as an embodiment. This apparatus is a color image forming apparatus of the electrophotographic type.

The reference numeral 1 designates the outer housing of an apparatus body, and the letter A denotes an original scanning and reading portion disposed on the upper portion of the outer housing of the apparatus body. An original O is set on original supporting table glass 2 with its image bearing surface turned downward on a predetermined apparatus standard, and an original keep plate 3 is put thereon and reading is started, whereby a movable optical system 4 under the original supporting table glass is moved along the lower surface of the original supporting table glass from one side to the other side and the downwardly facing image bearing surface of the original set on the original supporting table glass 3 is illuminated and scanned, and the reflected light of the illuminating and scanning light reflected from the surface of the original is imaged on a photoelectric reading unit 5 and is color-resolved by a color resolving filter and also, each color-resolved component image of the original image is photoelectrically read as a color image signal (a time-serial electrical digital pixel signal) and is stored in a memory circuit.

The reference numeral 6 designates an electrophotographic photosensitive drum as the image bearing member of an image forming portion. This photosensitive drum 6 has, for example, a diameter of 180 mm and is rotatively driven at a predetermined process speed (peripheral speed) in the clockwise direction indicated by arrow.

The reference numeral 7 denotes a charger for uniformly charging the photosensitive drum 6 to a predetermined polarity and potential, and the reference numeral 8 designates image exposure means comprising a laser output portion, a polygon mirror, a lens system, a mirror, etc. The charged surface of the photosensitive drum by the charger 7 is scanned and exposed by a laser beam E modulated and outputted from the image exposure means 8 correspondingly to the time-serial electrical digital pixel signal from the memory circuit, whereby an electrostatic latent image corresponding to the scanned and exposed pattern is formed on the surface of the rotatable photosensitive drum 6.

The reference numeral 9 denotes a compound developing device having a cyan developing device 9C containing a cyan toner therein, a magenta toner developing device 9M containing a magenta toner therein, an yellow toner developing device 9Y containing an yellow toner therein, and a black developing device 9K containing a black toner therein, and these four developing devices 9C, 9M, 9Y and 9K selectively act on the rotatable photosensitive drum 6, whereby the electrostatic latent image on the surface of the rotatable photosensitive drum 6 is toner-developed.

The reference numeral 11 designates a transfer drum which, at a position next to the compound developing device 9, is in contact with the photosensitive drum and is rotatively driven at substantially the same peripheral speed as that of the photosensitive drum 6 in a forward direction relative to the rotation of the photosensitive drum 6.

This transfer drum 11 has, for example, a diameter of 180 mm and in the opening area of the peripheral surface thereof, a recording medium carrying sheet 11*a* formed of a film-like dielectric material which is recording medium carrying means is cylindrically and integrally extended. There are also disposed an adsorbing corona charger 11*b* which is adsorbing charging means for adsorbing a recording medium to the outer peripheral surface of the transfer drum 11, an adsorbing (bearing) roller 11*c* as an electrode opposed thereto, a transferring corona charger 11*d* for causing the toner images on the photosensitive drum to be transferred to the recording medium adsorbed to the transfer drum 11, an inner corona charger 11*e*, an outer corona charger 11*f*, a recording medium separating charger 11*g*, a recording medium separating pawl 11*h*, etc.

The reference numerals 12, 13 and 14 denote first to third automatic recording medium supply mechanisms, and the reference numeral 15 designates a manual recording medium supply portion. Recording mediums (transfer mediums) P are supplied one by one from one of the first to third automatic recording medium supply mechanisms 12, 13 and 14, pass along a predetermined sheet path comprising a guide plate, a pair of conveying rollers, etc. and are conveyed to a pair of register rollers 16. Or, recording mediums are conveyed from the manual recording medium supply portion 15 to the pair of register rollers 16.

The recording medium is then fed to the transfer drum 11 at predetermined timing by the pair of register rollers 16, is wound around the outer peripheral surface of the transfer drum 11, is electrostatically held thereon and is rotated with the transfer drum 11, and the toner images on the photosensitive drum 6 are transferred to the outer surface of the recording medium by the transferring corona charger 11*d*. After the transfer of the toner images to the recording medium P, the surface of the rotatable photosensitive drum 6 is cleaned by a cleaner (cleaning device) 10, whereby any residual materials adhering thereto such as toners left after transfer are removed.

In the case of the full color image forming mode, the following four image forming and transferring cycles (1)–(4) are successively executed with the rotation of the photosensitive drum 6 and transfer drum 11 continued:

(1) Charging Of the rotatable photosensitive drum 6→image exposure E by a laser beam modulated by the cyan image signal of the aforedescribed color-resolved image signals of the desired color image→development by the cyan developing device 9C→transfer of the cyan toner image to the recording medium P→the step of cleaning the rotatable photosensitive drum 6;

(2) Charging of the rotatable photosensitive drum 6→image exposure E by a laser beam modulated by the magenta image signal of the aforedescribed color-resolved image signals of the desired color image →development by the magenta developing device 9M →transfer of the magenta toner image to the recording medium P→the step of cleaning the rotatable photosensitive drum 6;

(3) Charging of the rotatable photosensitive drum 6→image exposure E by a laser beam modulated by the yellow image signal of the aforedescribed color-resolved image signals of the desired color image →development by the yellow developing device 9Y →transfer of the yellow toner image to the recording medium P→the step of cleaning the rotatable photosensitive drum 6; and (4) Charging of the rotatable photosensitive drum 6→image exposure E by a laser beam modulated by the black image signal of the aforedescribed color-resolved image signals of the desired color image→development by the black developing device 9K→transfer of the black toner image to the recording medium P→the step of cleaning the rotatable photosensitive drum 6.

Thereby, the above-mentioned four toner images, i.e., the cyan toner image, the magenta toner image, the yellow toner image and the black toner image, are registered with one another in a predetermined manner relative to the outer surface (first surface) of the same recording medium P twining and held on the rotatable transfer drum 11 and superposedly transferred to the recording medium P, whereby a color toner image corresponding to the desired color image is formed on the recording medium P.

When the superposition transfer of the four color toner images to the same recording medium P held on the rotatable transfer drum 11 is terminated, the recording medium has its charges removed by the separating charger 11*g*, is separated from the transfer drum 11 by the separating pawl 11*h* as separating means, and is conveyed to a fixing device (in the present embodiment, a heat roller fixing device) 18 by conveying means 17, and the four color toner images are collectively fixed on the surface of the recording medium.

In the case of the one-side image forming mode, a recording medium having left the fixing device 18 on one surface (first surface) of which the formation and fixing of an image have been finished is discharged onto a paper discharge tray 20 outside the apparatus through a paper discharge port 19.

In the case of the both-side image forming mode, the recording medium having left the fixing device 18 on one surface of which the formation and fixing of an image have been finished is introduced into a reconveying sheet path a, passes along the route of a switchback sheet path b→a sheet path c, is reversed and is conveyed to an intermediate tray 21. It is then conveyed from this intermediate tray 21 to the pain of register rollers 16, is again fed to the transfer drum 11, and is wound and held on the transfer drum 11 with its first surface on which image formation has been finished turned inward and its second surface turned outward.

Like the image formation on the first surface of the recording medium, the four color-resolved toner images of a color image for the second surface successively formed on the photosensitive drum 6 are successively transferred to the second surface of the recording medium, whereby a color toner image is formed thereon.

The recording medium is then separated from the transfer drum 11 and is again conveyed to the fixing device 18, where the four color toner images formed on the second surface of the recording medium are collectively fixed, whereafter the recording medium on which full color both-side image formation has been finished is discharged onto the paper discharge tray 20 through the paper discharge port 19.

A recording medium on which one surface (first surface) image formation and fixing has been finished may be once discharged onto the paper discharge tray 20, whereafter the recording medium may be reversed so that its second surface may face upward, and may be again introduced from the manual paper supply portion 15 into the apparatus and image formation on the second surface may be executed.

The order of the formation of the four color-resolved toner images is not limited to the order in the present embodiment. In the case of black-and-white image copying, the black developing device 9K alone operates. The both-side copy mode for black-and-white images and the image forming mode for forming a color image on one surface of a recording medium and forming a black-and-white image on the other surface of the recording medium can also be selectively executed.

Figure 5:
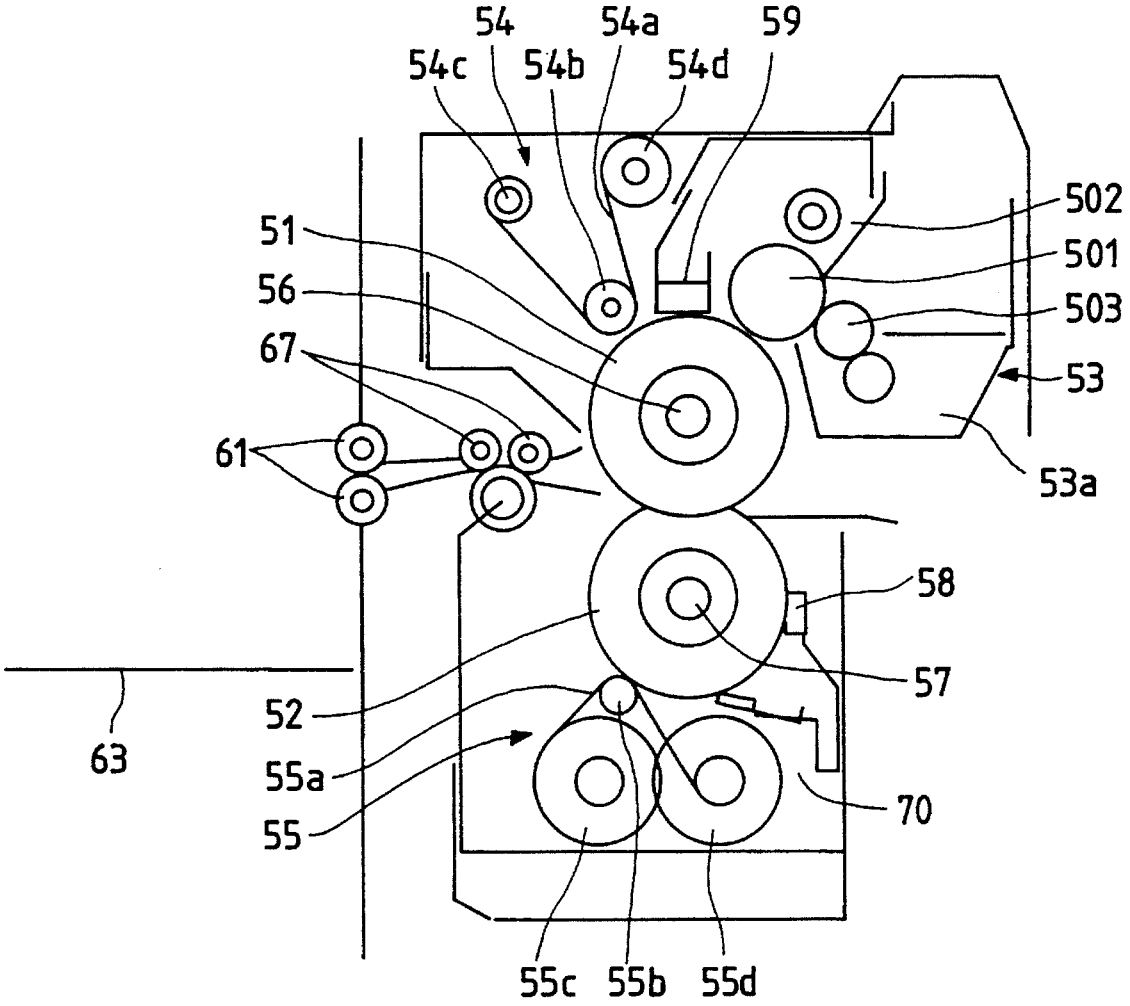
FIG. 5 is a cross-sectional view of a fixing device in the apparatus of FIG. 4.

FIG. 5 is a schematic view showing an example of the fixing device of a full color image forming apparatus. The fixing device 18, as shown in FIG. 5, is provided with a mixing roller 51 which is a fixing rotatable member having therein a halogen heater 56 which is a heating source, a pressing roller 52 which is a pressing rotatable member having therein a halogen heater 57 which is a heating source and rotatably urged against the fixing roller (in some cases, the pressing roller does not have the halogen heater 57 therein), silicone oil which is a parting agent an oil applying device 53 for applying to the surface of the fixing roller 51, and cleaning devices 54 and 55 for removing toners adhering to the surfaces of the fixing roller 51 and the pressing roller 52.

Each of the fixing roller 51 and the pressing roller 52 is comprised of a lower layer formed of HTV (high temperature vulcanized type) silicone rubber on a mandrel made of aluminum, an intermediate layer formed of fluorine rubber for preventing the entry of oil outside of the lower layer, and a surface layer formed of LTV (low temperature vulcanized type) or RTV (room temperature vulcanized type) silicone rubber well concordant with silicone oil as parting agent further outside of the intermediate layer, and the fixing roller 51 and the pressing roller 52 cooperate with each other to form a nip portion for nipping and conveying a recording medium therebetween. Resin-like polyorganosiloxane and 1 percent by weight of silica powder are mixed with the addition type silicone rubber of the surface of the fixing roller, and resin-like polyarganosiloxane and 5 percent by weight of silica powder are mixed with the addition type silicone rubber of the surface of the pressing roller.

Thus, in the case of a color image forming apparatus, it is necessary to sufficiently melt and mix toners and therefore, generally, soft rollers using an elastic material such as rubber are often used. Also, in the case of a fixing device in a both-side color image forming apparatus, the toner parting property is required of both the fixing roller 51 and the pressing roller 52 and therefore, silicone rubber is often used for the surface layers of the both rollers.

The heating operation of the halogen heaters 56 and 57 is controlled by temperature control means (not shown). The temperature control means controls the operation of the halogen heaters 56 and 57 on the basis of the surface temperatures of the fixing roller 51 and pressing roller 52 detected by thermistors 58 and 59.

The oil applying device 53 is movable toward and away from the fixing roller, and moves silicone oil in an oil reservoir 53*a* toward an applying roller 501 by a draw-up roller 503 and applies the silicone oil to the surface of the fixing roller 51 by the applying roller 501. The movement of the oil applying device 53 toward and away from the fixing roller 51 is controlled by the ON/OFF of a solenoid, not shown. The amount of silicone oil applied to the fixing roller 51 is controlled by a control blade 502 and is determined by the direction of contact, the angle pressure, etc. of this blade 502.

Part of the oil applied to the fixing roller 51 is absorbed by the recording medium during fixing and the remainder of the oil shifts to the pressing roller 52 side and is scraped off by an oil scraping blade 70. The oil scraping blade 70 is made of fluorine rubber or the like, whereby excess oil on the surface of the roller is prevented from collecting in the nip portion to thereby cause OHP film or the like to slip in the nip portion.

The cleaning devices 54 and 55 comprise heat-resistant unwoven fabric NORMEX (trade name) or webs 54*a*, 55*a* plated with nickel on this NORMEX by the electroless plating method, rollers 54*b*, 55*b* for urging these cleaning webs 54*a*, 55*b* toward the fixing roller 51 and the pressing roller 52, respectively, unwinding rollers 54*c*, 55*c* for letting out the cleaning webs 54*a*, 55*a*, and take-up rollers 54*d*, 55*d* for taking up the cleaning webs 54*a*, 55*a*.

In such an apparatus, when a recording medium is conveyed to the fixing device 18, the fixing roller 51 and pressing roller 52 are rotated at a predetermined speed and the recording medium is pressed and heated from its both surfaces while passing between the rollers 51 and 52, and unfixed toners carried thereon are melted, whereby fixing is effected. Also, at this time, the toners adhering to the fixing roller 51 and pressing roller 52 are removed by the cleaning devices 54 and 55.

In order to examine the toner parting property and physical strength of the addition type silicone rubber made in Embodiments 1 to 7 and Comparative Examples 1 and 2 by the use of such an apparatus to which the present invention is applicable, the comparison of performance was made by the single-layer roller for fixing shown in FIG. 1.

The roller for fixing used in the experiment was made in the following manner.

DY39-051 (produced by Tore and Dowcorning Co., Inc.) as an adhesive layer was applied to an aluminum mandrel having an outer diameter of 58 mm and was heated and dried at 200° C. On this mandrel, the abovedescribed addition type silicone rubber was hardened at 150° C. for 40 minutes, thereby making fixing rollers and pressing rollers each having the addition type silicone rubber of Embodiments 1 to 7 and Comparative Examples 1 and 2 on the surface layer of an outer diameter 60 mm (the thickness of the silicone rubber being 1 mm) which contacts with toners.

These fixing and pressing rollers were used in the fixing device of the color copying apparatus capable of effecting both-side image formation shown in FIG. 5 by a forcible test of a set temperature 200° C., and both-side image formation was done up to 20,000 sheets.

The parting property of toners was examined by the number of copies during the occurrence of the offset of the toners to the rollers, and the heat resisting strength was examined by the number of copies for which the surfaces of the rollers were injured.

The results are summarized in Table 3 below.

TABLE 3

| | fixing roller | | pressing roller | |
|---|---|---|---|---|
| | number of copies till occurrence of offset | number of copies till occurrence of injury | number of copies till occurrence of offset | number of copies till occurrence of injury |
| Embodiment 1 (silica 0.1%) | not occurred up to 20,000 sheets | not occurred up to 20,000 sheets | not occurred up to 20,000 sheets | not occurred up to 20,000 sheets |
| Embodiment 2 (silica 0.5%) | not occurred up to 20,000 sheets | not occurred up to 20,000 sheets | not occurred up to 20,000 sheets | not occurred up to 20,000 sheets |
| Embodiment 3 (silica 1%) | not occurred up to 20,000 sheets | not occurred up to 20,000 sheets | not occurred up to 20,000 sheets | not occurred up to 20,000 sheets |
| Embodiment 4 (silica 2%) | not occurred up to 20,000 sheets | not occurred up to 20,000 sheets | not occurred up to 20,000 sheets | not occurred up to 20,000 sheets |
| Embodiment 5 (silica 3%) | occurred for 10,000 sheets or less | not occurred up to 20,000 sheets | not occurred up to 20,000 sheets | not occurred up to 20,000 sheets |
| Embodiment 6 (silica 5%) | occurred for 10,000 sheets or less | not occurred up to 20,000 sheets | not occurred up to 20,000 sheets | not occurred up to 20,000 sheets |
| Embodiment 7 (silica 8%) | occurred for 10,000 sheets or less | not occurred up to 20,000 sheets | not occurred up to 20,000 sheets | not occurred up to 20,000 sheets |
| Comp. Ex. 1 (silica 0%) | not occurred up to 20,000 sheets | occurred for 16,000 sheets or less | occurred for 16,000 sheets or less | occurred for 9,000 sheets or less |
| Comp. Ex. 2 (silica 10%) | occurred for 5,000 sheets or less | not occurred up to 20,000 sheets | occurred for 12,000 sheets or less | not occurred up to 20,000 sheets |

As shown in Table 3 in the case of the fixing roller, when the amount of silica was 0 percent by weight, injury occurred for 16,000 sheets or less. Also, when the amount of silica was 3 percent by weight or more, offset occurred for 10,000 sheets or less. Accordingly, it is seen that in the fixing roller, an amount of silica of 1 to 2 percent by weight is preferable from the viewpoints of parting property and heat resisting property. Also, in the case of the pressing roller, when the amount of silica was 0.1 percent by weight or less, injury occurred for 10,000 sheets or less, and when the amount of silica was 10 percent by weight, offset occurred for 12,000 sheets or less. Accordingly, in the pressing roller, an amount of silica of 0.5 to 8 percent by weight is preferable from the viewpoints of parting property and heat resisting property. Thus, by applying the present invention to at least one of the fixing roller and the pressing roller, there can be provided a fixing device excellent in parting property and heat resisting property. Also, by a fixing roller and a pressing roller using the addition type silicone rubber of the present invention being used in the fixing device of a full color both-side image forming apparatus, there can be provided a fixing device capable of fixing both-side images and excellent in toner parting property, physical strength and heat resisting property. It has been found that particularly in a both-side image fixing device, the parting property is strongly required of the fixing roller and the physical strength and the heat resisting property are strongly required of the pressing roller. This is because as previously described, the oil scraping blade for scraping off any excess oil on the surface of the roller is in contact with the pressing roller, whereby when the number of copies becomes great, paper powder and toners adhering to the roller are liable to adhere to the oil scraping blade to thereby injure the pressing roller. Accordingly, by a roller using the addition type silicone rubber having a great amount of inorganic fine powder therein on the surface layer being used on the pressing roller side rather than on the fixing roller side, there can be provided a both-side image fixing device of long life in which the lives of the rollers for fixing can be adjusted to each other and which avoids waste.

As reinforcing resin-like polyorganosiloxane to be mixed the polysiloxane mixture used in the aforedescribed construction, use can be made of one having a ladder polymer, or a block polymer having in one and the same molecule a segment including at least one of tetrafunctionality and trifunctionality and a normal chain-like oil segment having at least 100 trifunctional construction units on end, and by the mixing of such reinforcing resin-like polyorganosiloxane, there can be obtained good physical strength and toner parting property.

Also, the inorganic fine powder as the heat resistance imparting agent used in the aforedescribed instruction is inorganic fine powder of an average particle diameter of 10 to 1000 nm of silica (silicon oxide), alumina (aluminum oxide), titanium oxide, calcium carbonate or the like made by the wet method or the dry method.

As such inorganic fine powder, use can also be made of one having is surface treated by an organic compound such as alkyl radical like methyl radical or alkoxy radical like methoxy radical, an organic silicon compound such as silanol radical, or an organic metal compound such as titanate, aluminate or zirconate to thereby enhance dispersibility and coupling property.

While the embodiments of the present invention have been described above, the present invention is not restricted to the above-described embodiments, but all modifications are possible within the technical idea of the present invention.

What is claimed is:

1. A fixing rotatable member comprising:

a base member; and an elastic layer provided on a surface of said fixing rotatable member;

said elastic layer being addition type silicone rubber in which resin-like polyorganosiloxane and 0.1 to 2 percent by weight of inorganic fine powder are mixed.

2. A fixing rotatable member according to claim 1, wherein said inorganic fine powder is silica.

3. A fixing rotatable member according to claim 1, wherein said elastic layer is provided on said base member.

4. A fixing rotatable member according to claim 1, wherein said elastic layer is provided on said base member with another elastic layer interposed therebetween.

5. A fixing rotatable member according to claim 1, wherein said elastic layer is in contact with an unfixed toner image.

6. A pressing rotatable member comprising:

a base member; and an elastic layer provided on a surface of said pressing rotatable member;

said elastic layer being addition type silicone rubber in which resin-like polyorganosiloxane and 0.5 to 8 percent by weight of inorganic fine powder are mixed.

7. A pressing rotatable member according to claim 6, wherein said inorganic fine powder is silica.

8. A pressing rotatable member according to claim 6, wherein said elastic layer is provided on said base material.

9. A pressing rotatable member according to claim 6, wherein said elastic layer is provided on said base material with another elastic layer interposed therebetween.

10. A pressing rotatable member according to claim 6, wherein said elastic layer is in contact with a surface opposite to an unfixed toner image on a recording medium carrying an unfixed toner image thereon.

11. A fixing device comprising:

a fixing rotatable member having an elastic layer on a surface of said fixing rotatable member; and a pressing rotatable member having an elastic layer on a surface of said pressing rotatable member;

said fixing rotatable member and said pressing rotatable member forming a nip therebetween, and holding and conveying a recording medium carrying an unfixed toner image thereon by said nip to thereby effect fixing;

the elastic layer of said fixing rotatable member being addition type silicone rubber in which resin-like polyorganosiloxane and 0.1 to 2 percent by weight of inorganic fine powder are mixed, the elastic layer of said pressing rotatable member being addition type silicone rubber in which resin-like polyorganosiloxane and 0.5 to 8 percent by weight of inorganic fine powder are mixed.

12. A fixing device according to claim 11, wherein the inorganic fine powder of said fixing rotatable member and of said pressing rotatable member is silica.

13. A fixing device according to claim 11, wherein said fixing rotatable member is in contact with the unfixed toner image.

14. A fixing device according to claim 11, wherein said device fixes an unfixed toner image carried on a first surface of the recording medium, thereafter, fixes an unfixed toner image carried on a second surface of the recording medium.

15. A fixing device comprising:

a fixing rotatable member having an elastic layer on a surface of said fixing rotatable member; and a pressing rotatable member having an elastic layer on a surface of said pressing rotatable member;

said fixing rotatable member and said pressing rotatable member forming a nip therebetween, and holding and conveying a recording medium carrying an unfixed toner image thereon by said nip to thereby effect fixing;

the elastic layers of said fixing rotatable member and said pressing rotatable member each containing inorganic fine powder, an amount of the inorganic fine powder of said pressing rotatable member being greater than an amount of the inorganic fine powder of said fixing rotatable member.

16. A fixing device according to claim 15, wherein the inorganic fine powder of said fixing rotatable member and of said pressing rotatable member is silica.

17. A fixing device according to claim 15, wherein said fixing rotatable member is in contact with the unfixed toner image.

18. A fixing device according to claim 15, wherein the device fixes an unfixed toner image carried on a first surface of the recording medium, thereafter, fixes an unfixed toner image carried on a second surface of the recording medium.

19. A fixing device according to claim 15, wherein the elastic layers of said fixing rotatable member and said pressing rotatable member are addition type silicone rubber.

20. A fixing device according to claim 15, wherein the amount of the inorganic fine powder contained in the elastic layer of said fixing rotatable member is 0.1 to 2 percent by weight.

21. A fixing device according to claim 15, wherein the amount of the inorganic fine powder contained in the elastic layer of said pressing rotatable member is 0.5 to 8 percent by weight.

* * * * *

UNITED STATES PATENT AND TRADEMARK OFFICE

CERTIFICATE OF CORRECTION

PATENT NO. : 5,608,508

DATED : March 4, 1997

INVENTOR(S) : Hiroaki KUMAGAI, et al.

It is certified that error appears in the above-indentified patent and that said Letters Patent is hereby corrected as shown below:

COLUMN 4

Line 40, "+45" should read --+45%--.

COLUMN 6

Line 25, "Embodiment 5"
(silica 34%) should read --Embodiment 5
(silica 3%)--

COLUMN 10

Line 18, "polyarganosiloxane" should read --polyorganosiloxane--.

COLUMN 11

Line 12, "Dowcorning" should read --Dow Corning--.

Table 3, "not occurring up to 20,000 sheets" should read --occurred for 10,000 sheets or less--. (Col. 5, 1st occurrence).

UNITED STATES PATENT AND TRADEMARK OFFICE

CERTIFICATE OF CORRECTION

PATENT NO. : 5,608,508

DATED : March 4, 1997

INVENTOR(S) : Hiroaki KUMAGAI, et al.

It is certified that error appears in the above-indentified patent and that said Letters Patent is hereby corrected as shown below:

COLUMN 13

Line 20, "is" should read --its--

Signed and Sealed this

Fifth Day of August, 1997

Bruce Lehman

*Attest:*

BRUCE LEHMAN

*Attesting Officer*

*Commissioner of Patents and Trademarks*